US006327131B1

(12) United States Patent
Thomas et al.

(10) Patent No.: US 6,327,131 B1
(45) Date of Patent: Dec. 4, 2001

(54) GROUNDING APPARATUS FOR A CART AND METHOD OF TRANSPORTATION

(75) Inventors: Floyd L. Thomas; Loren J. Scheman, both of Mesa, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/474,682

(22) Filed: Dec. 29, 1999

(51) Int. Cl.[7] ..... H05F 3/00

(52) U.S. Cl. ..... 361/212; 361/217; 361/219; 361/220

(58) Field of Search ..... 361/212, 216–217, 361/219, 220–221

(56) References Cited

U.S. PATENT DOCUMENTS 2,549,471 * 4/1951 Hutchison ..... 361/219
2,753,491 * 7/1956 Legge ..... 361/219
4,321,653 * 3/1982 Takahashi ..... 361/219
4,415,946 * 11/1983 Pitts ..... 361/212
4,484,250 * 11/1984 Rzepecki et al. ..... 361/220
4,491,894 * 1/1985 Pitts ..... 361/212
4,720,048 * 1/1988 Maroney et al. ..... 280/47.34
4,885,659 * 12/1989 Nowell et al. ..... 361/212
4,934,022 * 6/1990 Lissner ..... 16/18 R

* cited by examiner

*Primary Examiner*—Michael J. Sherry
(74) *Attorney, Agent, or Firm*—S. Kevin Pickens

(57) ABSTRACT

A transportation apparatus for transporting components (240) sensitive to electrostatic discharge includes an electically conductive cart (220), an electrically conductive pad (231) coupled to the electrically conductive floor to ground the cart, an electrically conductive cable (232) coupled to the cart, and a fastening device (233) coupling the pad to the cable. The cart transports the components across an electrically conductive floor (200) from one location to another while the cart remains grounded by the electrically conductive pad.

25 Claims, 2 Drawing Sheets

GROUNDING APPARATUS FOR A CART AND METHOD OF TRANSPORTATION

FIELD OF THE INVENTION

This invention relates, in general, to the transportation and storage of components sensitive to electrostatic discharge, and more particularly, to the grounding of carts used to transport components.

BACKGROUND OF THE INVENTION

Carts are often used to transport semiconductor components from one location to another. However, the semiconductor components may be damaged by electrostatic discharge during the transportation. Therefore, the carts should be grounded to protect the semiconductor components. One technique for grounding a cart includes dragging a grounding cable from the cart across a conductive floor, where the grounding cable consists of a metal ball on the end of a metal cable. Other techniques for grounding a cart includes dragging a chain from the cart across the conductive floor or using conductive wheels on the carts.

However, such grounding techniques do not provide a constant ground for the cart because the conductive floors commonly used in the art are not entirely conductive, but merely have a plurality of very small conductive regions on the floor. Therefore, the cart is not grounded when the grounding cable, the drag chain, or the conductive wheels move between conductive regions on the floor. Furthermore, while loading the semiconductor components onto the cart and while unloading the components from the cart, the cart remains stationary and may remain ungrounded during the entire loading and unloading process. Accordingly, the semiconductor components may still be damaged by electrostatic discharge using these common grounding techniques. One technique for grounding stationary carts uses a grounding cable that the user of a cart must connect from the cart to a grounding station. However, this technique is not automatic so the cart may inadvertently remain ungrounded.

Accordingly, a need exists for an improved grounding apparatus for a cart and an improved method of transporting components sensitive to electrostatic discharge. It is desired for the apparatus and the method to be inexpensive and easy to implement.

BRIEF DESCRIPTION OF THE DRAWINGS

The present invention will be better understood from a reading of the following detailed description, taken in conjunction with the accompanying drawing figures in which.

Figure 1:
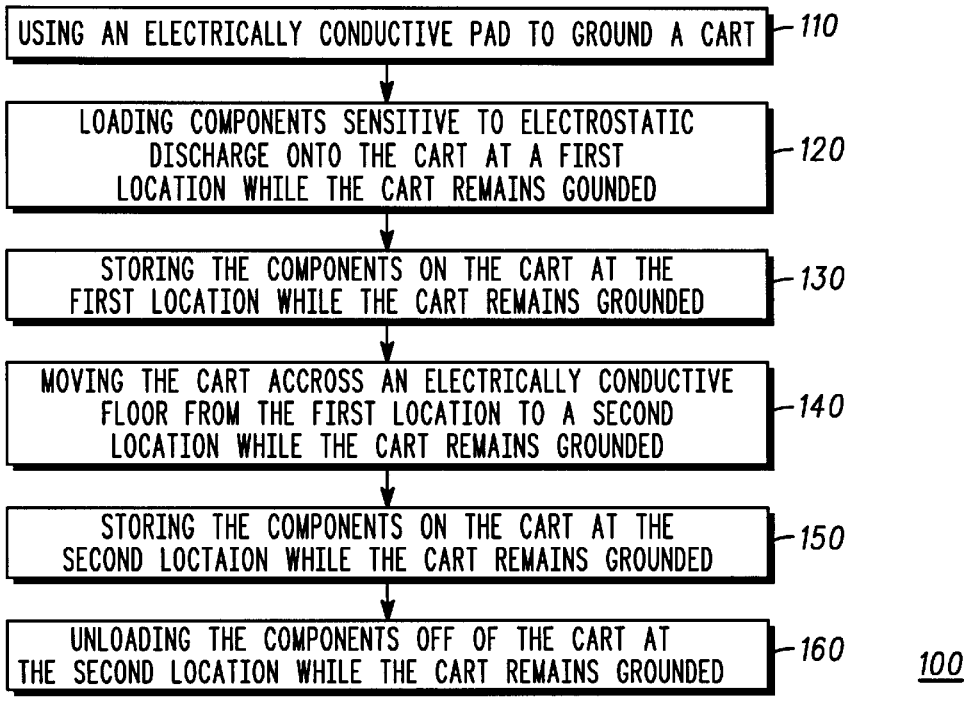
FIG. 1 outlines a method of transporting components in accordance with the present invention.

For simplicity and clarity of illustration, the drawing figures illustrate the general manner of construction, and elements in the drawing figures are not necessarily drawn to scale. Additionally, the same reference numerals in different figures denote the same elements, and descriptions and details of well-known features and techniques are omitted to avoid unnecessarily obscuring the present invention. Furthermore, the terms left, right, front, back, top, bottom, over, under, and the like in the description and in the claims, if any, are used for descriptive purposes. However, it is understood that the embodiment of the invention described herein is capable of operation in other orientations than described or illustrated herein. It is further understood that the terms so used are for the purposes of describing relative positions and are interchangeable under appropriate circumstances.

DETAILED DESCRIPTION OF THE DRAWINGS

FIG. 1 outlines a method 100 of transporting components that are sensitive to electrostatic discharge. At a step 110, an electrically conductive pad is used to ground a cart. Additional details of the electrically conductive pads are described hereinafter. Next, at a step 120, components sensitive to electrostatic discharge are loaded onto the cart at a first location while the cart is constantly grounded by the electrically conductive pad. At an additional step 130, the components can be stored on the cart at the first location while the cart remains constantly grounded by the electrically conductive pad. Then, at a step 140, the cart is moved across an electrically conductive floor from the first location to a second location while the cart still remains constantly grounded by the electrically conductive pad. At an optional step 150, the components can be stored on the cart at the second location while the cart remains constantly grounded by the electrically conductive pad. Subsequently, at a step 160, the components are unloaded off of the cart at the second location while the cart remains constantly grounded by the electrically conductive pad. In method 100, a single technique is used to constantly or consistently ground the cart during the loading, storing, moving, and unloading steps. Method 100 does not require using a first grounding technique during the loading and first storing steps, changing to a different grounding technique during the moving step, and changing back to the first grounding technique or using a third grounding technique during the second storing and unloading steps. Accordingly, method 100 provides a more simple and cost effective technique to ground a cart.

Figure 2:
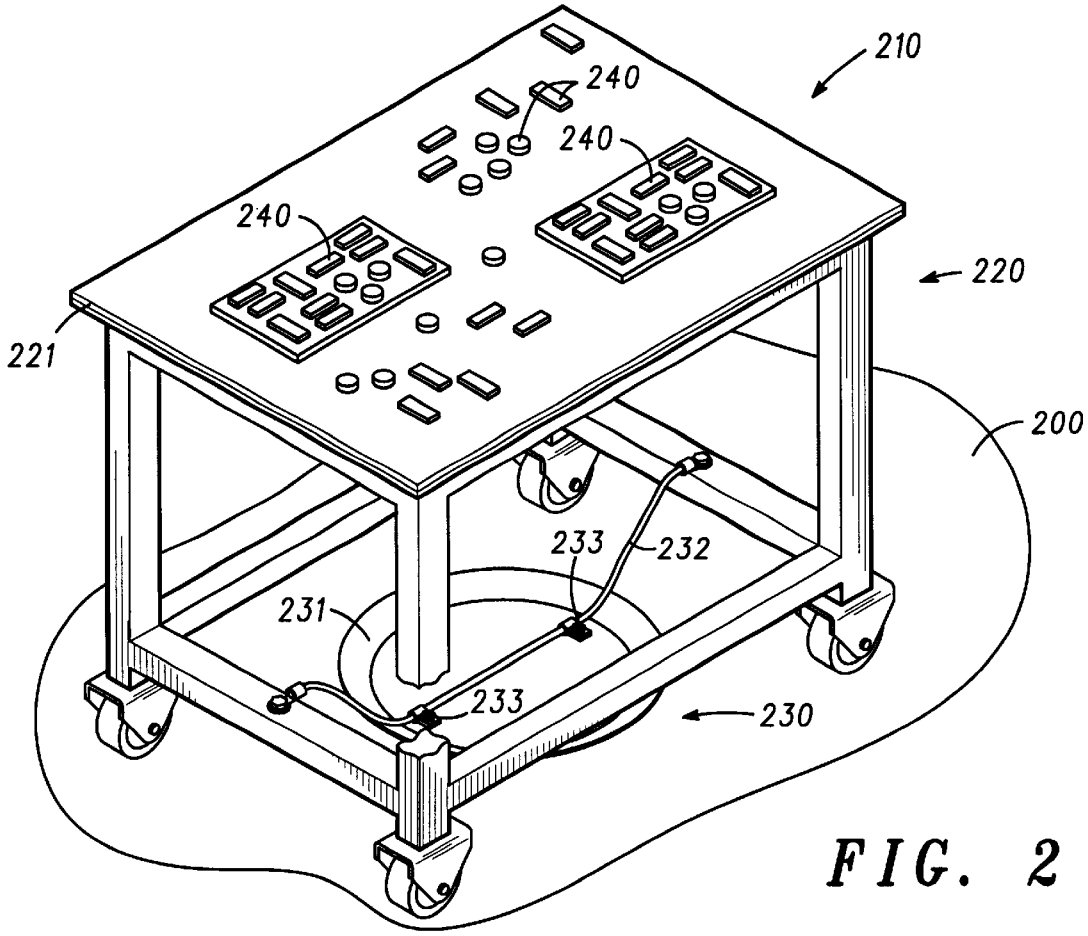
FIG. 2 illustrates an isometric view of an embodiment of a transportation apparatus having a grounding apparatus in accordance with the present invention.

Turning to the next figure, FIG. 2 illustrates an isometric view of a transportation apparatus 210. Apparatus 210 is supported by an electrically conductive floor 200. Apparatus 210 is used to transport components 240 across electrically conductive floor 200 from a first location to a second location. In the preferred embodiment, components 240 are packaged semiconductor components and/or circuit board assemblies.

Apparatus 210 includes a cart 220 and a grounding apparatus 230 coupled to cart 220. In the preferred embodiment, cart 220 is electrically conductive and includes an electrically dissipative mat 221 to provide a protective support surface for components 240. Also, while cart 220 is illustrated in FIG. 2 to have a flat-top surface, one skilled in the art will understand that the top surface of cart 220 may not be smooth and may be comprised of a plurality of parallel rods or wires to prevent dust from collecting on top of cart 220.

Grounding apparatus 230 includes an electrically conductive pad 231 coupled to electrically conductive floor 200 to ground cart 220. Grounding apparatus 230 also includes a flexible electrically conductive wire or cable 232 located adjacent to a portion of pad 231 and coupling pad 231 to cart 220, and grounding apparatus 230 further includes fastening devices 233 coupling pad 231 to cable 232. A ballast or additional weight may be added to pad 231 to ensure that pad 231 has adequate contact with electrically conductive floor 230. Additional details of grounding apparatus 230 are provided hereinafter.

Figure 3:
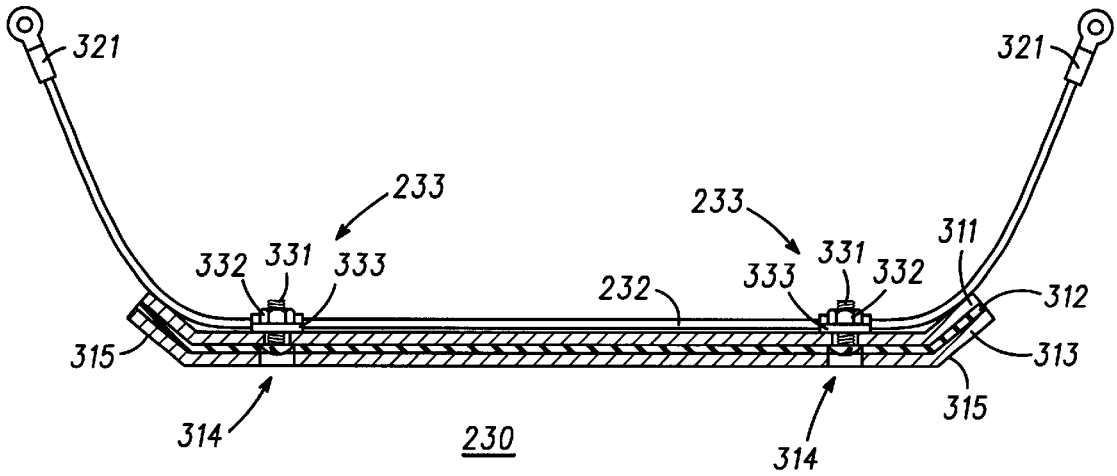
FIG. 3 illustrates a cross-sectional view of the grounding apparatus of FIG. 2.

FIG. 3 illustrates a cross-sectional view of grounding apparatus 230. As illustrated in the preferred embodiment of FIG. 3, electrically conductive pad 231 is comprised of layers 311, 312, and 313. Layer 311 is comprised of a malleable electrically conductive material such as, for example, aluminum. As an example, layer 311 can have a thickness of approximately 0.2 centimeters. Layer 311 is located over layer 312, which is comprised of an adhesive. Layer 312 is located between and couples together layers 311 and 313. Layer 312 is preferably comprised of an electrically conductive adhesive. As an example, the adhesive used to secure the electrically conductive floor can be used for layer 312.

In one embodiment, layer 313 is comprised of an electrically dissipative mat having a first electrically conductive side facing towards the electrically conductive floor and a second electrically conductive, but more resistive, side facing away from the electrically conductive floor and towards layers 311 and 312. In a different embodiment, layer 313 is comprised of an electrically conductive mat having a first electrically conductive side facing towards the electrically conductive floor and a second electrically conductive, and equally low resistive, side facing away from the electrically conductive floor and towards layers 311 and 312. Regardless of whether layer 313 is electrically dissipative or electrically conductive, layer 313 should be comprised of a material that is flexible or compliant to maintain adequate electrical contact with the electrically conductive floor. In the preferred embodiment, layer 313 is comprised of a rubber material filled with electrically conductive carbon fibers. As an example, layer 313 can have a thickness of approximately 0.15 centimeters, but the thickness of layer 313 may vary based on available supplies.

When layer 311 is comprised of aluminum, layer 311 is not smooth enough to maintain an adequate or reliable electrical contact with the electrically conductive floor. In the preferred embodiment, layer 311 is not a flexible or compliant material so that layer 311 can be bent or shaped to have a raised edge 315. Edge 315 enables grounding apparatus 230 to easily move over and across non-uniformities in the electrically conductive floor without flipping upside down or otherwise impeding the movement of the cart. In the preferred embodiment, edge 315 is bent approximately 30 degrees from the electrically conductive floor. As an example, edge 315 can have a width of approximately 2.5 centimeters.

Figure 4:
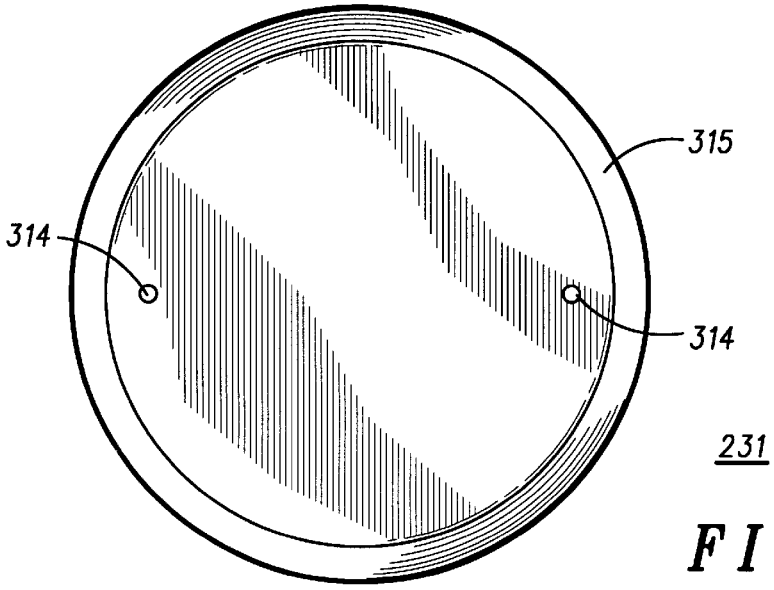
FIG. 4 illustrates a top view of a portion of the grounding apparatus of FIG. 2.

FIG. 4 illustrates a top view of electrically conductive pad 231. As illustrated in FIG. 4, pad 231 has a round or curved disc shape that is devoid of corners. In the preferred embodiment, pad 231 has a circular disc shape. The circular shape of pad 231 and the raised or bent configuration of edge 315 facilitate the movement of pad 231 over and across non-uniformities in the electrically conductive floor without impeding the movement of the cart.

Returning to FIG. 3, electrically conductive pad 231 has holes 314 in which fastening devices 233 are located. In the preferred embodiment, fastening devices 233 are electrically conductive. In the preferred embodiment, fastening devices 233 preferably includes metallic screws 331 in holes 314. Screws 331 are preferably countersunk into pad 231 and are preferably flat head 4–40 screws. Fastening devices 233 also preferably include metallic nuts 332 located over pad 231 and threadingly engaged with screws 331. Fastening devices 233 further preferably include metallic flags 333 located over pad 231 and underneath nuts 332.

Figure 5:
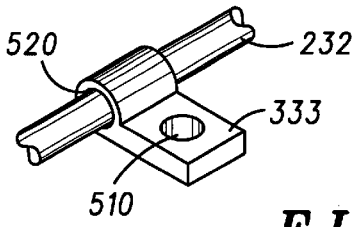
FIG. 5 illustrates an isometric view of a different portion of the grounding device of FIG. 2.

FIG. 5 illustrates an isometric view of a portion of cable 232 and one of flags 333. As illustrated in FIG. 5, the flag includes a flat portion having a first hole 510. Screw 331 (FIG. 3) is located in hole 510, and the flat portion of the flag serves as a washer to secure the nut onto the screw. The flag also includes a second hole 520 in which flexible electrically conductive cable 232 is located. Preferably, a portion of the flag forming hole 520 is crimped to keep cable 232 in place.

Returning to FIG. 3, cable 232 preferably has ring lugs 321 that are crimped onto the ends of cable 232 to couple cable 232 to the cart. As illustrated in FIG. 3, cable 232 overlies a portion of pad 231, and viewing FIGS. 3 and 4 in combination, one skilled in the art will understand that cable 232 preferably overlies a diameter of pad 231 where the diameter is preferably approximately 15 centimeters. In the preferred embodiment, cable 232 is comprised of a stranded copper or stainless steel cable having a diameter of approximately 0.2 centimeters. Also in the preferred embodiment, flexible electrically conductive cable 232 has a length long enough to permit pad 231 to have adequate contact with the electrically conductive floor, but short enough to keep pad 231 underneath the cart at all times while the cart transports the components across the electrically conductive floor. Accordingly, pad 231 preferably does not extend beyond the footprint of the cart during its use. This particular embodiment is desired for safety considerations such that the user of the cart or another person does not trip or stumble over grounding apparatus 230.

Therefore, an improved transportation apparatus having a grounding apparatus and an improved method of transporting components sensitive to electrostatic discharge is provided to overcome the disadvantages of the prior art. The grounding apparatus is easily adaptable to carts that are commonly used to transport components sensitive to electrostatic discharge. Furthermore, the grounding apparatus is simple and easy to use.

While the present invention has been particularly shown and described with reference to specific embodiments, it will be understood by those skilled in the art that various changes may be made to the embodiments herein without departing from the spirit or scope of the present invention. For instance, the numerous details set forth herein such as, for example, the material compositions and the dimensions are provided to facilitate the understanding of the present invention and are not provided to limit the scope of the present invention. Furthermore, holes 314 in pad 231 may extend only through layer 311 and may be absent from layers 312 and 313.

Accordingly, the disclosure of embodiments of the present invention is intended to be illustrative of the scope of the present invention and is not intended to be limiting. It is intended that the scope of the present invention shall be limited only to the extent required by the appended claims. The appended claims are not to be interpreted as including means-plus-function limitations, unless such a limitation is expressly recited in a given claim using the phrase "means for".

What is claimed is:

1. A grounding apparatus for a cart transporting components across an electrically conductive floor, the grounding apparatus comprising:

an electrically conductive pad coupled to the electrically conductive floor to ground the cart; and an electrically conductive cable located adjacent to a portion of the electrically conductive pad and coupling the electrically conductive pad to the cart.

2. The grounding apparatus of claim 1 wherein:

the electrically conductive pad comprises a flexible, electrically dissipative mat having a first electrically conductive side facing towards the electrically conductive floor and a the second electrically conductive side facing away from the electrically conductive floor; and the second electrically conductive side is more resistive than the first electrically conductive side.

3. The grounding apparatus of claim 2 wherein:

the electrically conductive pad comprises:

a rigid, electrically conductive layer over the flexible, electrically dissipative mat; and an adhesive located between and coupling together the rigid, electrically conductive layer and the flexible electrically dissipative mat; and the second electrically conductive side of the electrically dissipative mat faces towards the rigid, electrically conductive layer.

4. The grounding apparatus of claim 1 wherein:

the electrically conductive pad comprises a flexible, electrically conductive mat having a first electrically conductive side facing towards the electrically conductive floor and a second electrically conductive side facing away from the electrically conductive floor; and the second electrically conductive side is as resistive as the first electrically conductive side.

5. The grounding apparatus of claim 4 wherein:

the electrically conductive pad comprises:

a rigid, electrically conductive layer over the flexible, electrically conductive mat; and an electrically conductive adhesive located between and coupling together the rigid, electrically conductive layer and the flexible electrically conductive mat; and the second electrically conductive side of the electrically conductive mat faces towards the rigid, electrically conductive layer.

6. The grounding apparatus of claim 1 wherein:

the electrically conductive pad has a disk shape.

7. The grounding apparatus of claim 6 wherein:

the electrically conductive pad is devoid of corners.

8. The grounding apparatus of claim 1 wherein:

the electrically conductive pad has a circular disk shape.

9. The grounding apparatus of claim 1 wherein:

the electrically conductive pad has a raised edge.

10. The grounding apparatus of claim 9 wherein:

the raised edge is bent approximately 30 degrees from the electrically conductive floor.

11. The grounding apparatus of claim 1 wherein:

the electrically conductive pad has a hole.

12. The grounding apparatus of claim 11 comprising:

a fastening device in the hole coupling the electrically conductive pad to the electrically conductive cable.

13. The grounding apparatus of claim 11 comprising:

a screw in the hole; and a nut over the electrically conductive pad and threadingly engaged with the screw.

14. The grounding apparatus of claim 13 wherein:

the screw is countersunk into the electrically conductive pad.

15. The grounding apparatus of claim 13 comprising:

a flag over the electrically conductive pad and under the nut, wherein:

the flag has a first hole in which the screw is located; and the flag has a second hole in which the electrically conductive cable is located.

16. The grounding apparatus of claim 1 comprising:

ring lugs coupling ends of the electrically conducive cable to the cart.

17. The grounding apparatus of claim 1 wherein:

the electrically conductive cable has a length to keep the electrically conductive pad underneath the cart while the cart transports the components across the electrically conductive floor.

18. A grounding apparatus for a cart transporting components sensitive to electrostatic discharge across an electrically conductive floor, the grounding apparatus comprising:

an electrically conductive pad coupled to the electrically conductive floor to ground the cart, the electrically conductive pad comprising a rigid, electrically conductive layer, an adhesive located under the rigid, electrically conductive layer, and a flexible, electrically dissipative mat having a first electrically conductive side facing towards the electrically conductive floor and a second electrically conductive side facing away from the electrically conductive floor and towards the adhesive;

an electrically conductive cable overlying a portion of the electrically conductive pad and coupled to the cart; and an electrically conductive fastening device coupling the electrically conductive pad to the electrically conductive cable, wherein:

the electrically conductive pad has a round disk shape devoid of corners;

the electrically conductive pad has a raised edge bent approximately 30 degrees from the electrically conductive floor;

the electrically conductive pad has a hole in which the fastening device is located;

the second electrically conductive side of the electrically dissipative mat is more resistive than the first electrically conductive side of the electrically dissipative mat; and the electrically conductive cable has a length to keep the electrically conductive pad underneath the cart while the cart transports the components across the electrically conductive floor.

19. An electrically grounded transportation apparatus for transporting components sensitive to electrostatic discharge across an electrically conductive floor, the electrically grounded transportation apparatus comprising:

an electrically conductive cart;

an electrically conductive pad coupled to the electrically conductive floor to ground the electrically conductive cart and remaining under the electrically conductive cart while the electrically conductive cart transports the components across the electrically conductive floor;

an electrically conductive cable overlying a portion of the electrically conductive pad and coupled to the cart; and an electrically conductive fastening device coupling the electrically conductive pad to the electrically conductive cable.

20. The electrically grounded transportation apparatus of claim 19 wherein:

the electrically conductive pad has a round disk shape devoid of corners.

21. The electrically grounded transportation apparatus of claim 19 wherein:

the electrically conductive pad has a raised edge bent approximately 30 degrees from the electrically conductive floor.

22. The electrically grounded transportation apparatus of claim 19 wherein:

the electrically conductive pad has a hole in which the fastening device is located.

23. A method of transporting components comprising:

using an electrically conductive pad to ground a cart;

loading components sensitive to electrostatic discharge onto the cart at a first location while the cart remains grounded by the electrically conductive pad;

moving the cart across an electrically conductive floor from the first location to a second location while the cart remains grounded by the electrically conductive pad; and unloading the components off of the cart at the second location while the cart remains grounded by the electrically conductive pad.

24. The method of claim 23, comprising:

storing the components on the cart at the first location while the cart remains grounded by the electrically dissipative pad.

25. The method claim 23, comprising:

storing the components on the cart at the second location while the cart remains grounded by the electrically dissipative pad.

* * * * *